US010655382B2

(12) United States Patent
Braun et al.

(10) Patent No.: US 10,655,382 B2
(45) Date of Patent: May 19, 2020

(54) DOOR LITE FRAME ASSEMBLY

(71) Applicant: Therma-Tru Corp., Maumee, OH (US)

(72) Inventors: Michael Braun, Ft. Wayne, IN (US); Laura R. Bertsch, Auburn, IN (US)

(73) Assignee: THERMA-TRU CORP., Maumee, OH (US)

( * ) Notice: Subject to any disclaimer, the term of this patent is extended or adjusted under 35 U.S.C. 154(b) by 0 days.

(21) Appl. No.: 16/148,536

(22) Filed: Oct. 1, 2018

(65) Prior Publication Data

US 2020/0102784 A1 Apr. 2, 2020

(51) Int. Cl.
*E06B 3/58* (2006.01)
*E06B 3/72* (2006.01)

(52) U.S. Cl.
CPC ..... *E06B 3/5892* (2013.01); *E06B 3/72* (2013.01)

(58) Field of Classification Search
CPC .... E06B 3/5892; E06B 3/5878; E06B 3/5864; E06B 3/9636; E06B 3/2605; E06B 3/5821; E06B 3/5828; E06B 3/549; E06B 1/36; E06B 1/40; E06B 1/60; E06B 2003/6217; E06B 2003/6223; E06B 3/9861; E06B 3/9684; A47F 3/0434
USPC ..... 52/656.4, 656.5, 204.1, 204.55, 456, 52/565.5
See application file for complete search history.

(56) References Cited

U.S. PATENT DOCUMENTS 3,226,903 A * 1/1966 Lillethun ..... E06B 3/6604 52/172
3,576,092 A * 4/1971 Halpern ..... E06B 3/5892 52/456
4,241,556 A * 12/1980 Bursk ..... E06B 3/5828 49/171
4,280,309 A * 7/1981 Huelsekopf ..... E06B 1/04 52/204.54
5,018,330 A * 5/1991 Lewkowitz ..... E06B 3/5892 52/455

(Continued)

FOREIGN PATENT DOCUMENTS

CA 2874147 A1 6/2015

OTHER PUBLICATIONS www.plastproinc.com-features-and-benefits-doorlite-frames.
www.odl.com-doorglass_frames_trisys.htm.

*Primary Examiner* — Kyle J. Walraed-Sullivan
(74) *Attorney, Agent, or Firm* — Calfee, Halter & Griswold LLP

(57) ABSTRACT

A frame assembly for retaining a window panel in an aperture in a door. The frame assembly having a first frame member having a first outer face, a first window engaging surface, and a first door engaging surface, a second frame member having a second outer face, a second window engaging surface, and a second door engaging surface, a third frame member adapted to attach to the first outer face of the first frame member by a plurality of first screwless connectors, and a fourth frame member adapted to attach to the second outer face of the second frame member by a plurality of second screwless connectors. The first frame member is secured to the second frame member such that the window panel is held in the aperture between the first window engaging surface and the second window engaging surface and the door is held between the first door engaging surface and the second door engaging surface.

22 Claims, 8 Drawing Sheets

(56) References Cited

U.S. PATENT DOCUMENTS 5,105,597 A * 4/1992 Wilkening ..... E06B 3/5892 52/455
5,133,168 A * 7/1992 Neilly ..... E06B 3/5892 52/204.5
5,307,599 A * 5/1994 Herbst ..... E06B 3/685 52/207
5,577,355 A * 11/1996 Leonelli ..... E06B 3/5892 52/204.591
5,636,484 A * 6/1997 DeBlock ..... E06B 3/5892 52/171.1
5,644,881 A * 7/1997 Neilly ..... E06B 3/5892 49/505
5,934,030 A * 8/1999 McDonald ..... E06B 1/30 49/505
6,151,849 A * 11/2000 Twigg ..... E06B 3/5892 52/204.53
6,272,801 B1 * 8/2001 Suh ..... E06B 3/5892 49/505
6,553,735 B1 * 4/2003 Wang Chen ..... E06B 3/5892 52/204.6
6,922,946 B2 * 8/2005 Gerard ..... E06B 3/5892 49/380
6,925,767 B2 * 8/2005 Krochmal ..... E06B 3/5892 49/504
6,931,810 B2 * 8/2005 Beaudoin ..... E06B 3/54 52/213
7,448,174 B2 11/2008 Krochmal et al.
D635,689 S 4/2011 Van Faasen et al.
7,971,623 B2 * 7/2011 Barnard ..... E06B 3/549 160/116
8,359,796 B1 * 1/2013 Plummer ..... E06B 3/5892 52/204.61
8,434,284 B1 * 5/2013 Plummer ..... E06B 3/5892 52/745.16
8,572,929 B2 * 11/2013 Stumm ..... E06B 1/325 52/204.71
8,707,639 B2 * 4/2014 Thompson ..... E06B 1/36 49/504
8,904,733 B2 12/2014 Thompson
9,290,989 B2 * 3/2016 Lynch ..... E06B 3/5892
9,562,389 B2 * 2/2017 Badger ..... E06B 3/549
9,683,403 B2 * 6/2017 Wang ..... E06B 3/5892
10,012,018 B1 * 7/2018 Plummer ..... E06B 3/5892
2003/0000163 A1 * 1/2003 Lamanna ..... E06B 3/5892 52/204.62
2003/0009946 A1 * 1/2003 Wilson ..... E06B 7/09 49/74.1
2003/0019178 A1 * 1/2003 Wang Chen ..... E06B 3/5892 52/455
2003/0066256 A1 * 4/2003 DeBlock ..... B32B 17/10 52/208
2003/0084624 A1 * 5/2003 Wang Chen ..... E06B 3/5892 52/204.59
2003/0188498 A1 * 10/2003 Lewkowitz ..... E06B 3/5892 52/208
2004/0000109 A1 * 1/2004 Bourassa ..... E06B 3/54 52/204.54
2004/0003554 A1 * 1/2004 Beaudoin ..... E06B 3/54 52/204.54
2004/0068942 A1 * 4/2004 Krochmal ..... E06B 3/5892 52/204.71
2004/0083678 A1 * 5/2004 Tumlin ..... E06B 3/5892 52/717.01
2005/0016091 A1 * 1/2005 Chen ..... E06B 3/5892 52/204.1
2006/0080924 A1 * 4/2006 Sibbett ..... E06B 3/5892 52/455
2006/0198124 A1 * 9/2006 Copland ..... E06B 3/5892 362/145
2007/0107330 A1 * 5/2007 Culverson ..... E06B 1/702 52/204.5
2007/0193140 A1 * 8/2007 Carnick ..... E06B 3/5892 52/208
2007/0261326 A1 * 11/2007 Krochmal ..... E06B 3/5878 52/204.2
2008/0047208 A1 * 2/2008 Soltesiz ..... E06B 3/6604 52/204.595
2008/0196313 A1 * 8/2008 Fink ..... E06B 7/20 49/380
2008/0245003 A1 * 10/2008 Kon ..... E06B 3/5892 52/208
2009/0044467 A1 * 2/2009 Krochmal ..... E06B 3/5878 52/204.593
2010/0064625 A1 * 3/2010 Charlton ..... E06B 3/5892 52/656.4
2010/0229500 A1 * 9/2010 Lynch ..... E06B 3/5892 52/784.13
2010/0251635 A1 * 10/2010 Barnard ..... E06B 3/485 52/127.6
2011/0179730 A1 * 7/2011 Kolovich ..... E06B 1/12 52/204.2
2012/0055106 A1 * 3/2012 Phipps ..... E06B 7/30 52/204.591
2012/0137624 A1 * 6/2012 Sibbett ..... E06B 3/5892 52/656.5
2013/0139467 A1 * 6/2013 Thompson ..... E06B 1/36 52/656.5
2014/0053479 A1 * 2/2014 Valler ..... E06B 3/964 52/204.5
2014/0259525 A1 * 9/2014 Karl ..... E06B 3/5892 16/220
2014/0259948 A1 * 9/2014 Oberbroeckling .... E06B 3/7001 49/463
2014/0260063 A1 * 9/2014 Edwards ..... E06B 3/549 52/656.5
2015/0247355 A1 * 9/2015 Badger ..... E06B 3/549 52/208
2015/0252612 A1 * 9/2015 Charlton ..... E06B 3/5892 52/656.5
2015/0275513 A1 * 10/2015 Feldpausch ..... E04B 2/745 52/213
2016/0027098 A1 * 1/2016 Thornton ..... G06Q 30/0643 705/27.2
2016/0376835 A1 * 12/2016 Massey ..... E06B 7/16 49/398
2017/0130519 A1 * 5/2017 Miller ..... E06B 3/549
2017/0167185 A1 * 6/2017 Boer ..... E06B 1/18
2018/0080272 A1 * 3/2018 Fujishin ..... E06B 5/00
2018/0313137 A1 * 11/2018 Plummer ..... E06B 3/5892

* cited by examiner

DOOR LITE FRAME ASSEMBLY

FIELD OF THE INVENTION

The present application relates to window frame assemblies and more particularly to window frame assemblies for door lites.

BACKGROUND

Doors, such as residential entry doors, may include a semi-transparent or fully transparent window panel, known as a door lite, positioned within an aperture in the door. To attach the window panel to the door and hold it within the aperture, a door lite frame is typically used. Typical door lite frames include two frame members or halves that are positioned on opposite sides of the window panel and fastened or otherwise interconnected to one another and to the door to secure the window panel to the door.

SUMMARY

In one aspect of the present disclosure, a frame assembly is disclosed for retaining a window panel in an aperture in a door. The frame assembly includes a first frame member having a first outer face, a first window engaging surface, and a first door engaging surface, a second frame member having a second outer face, a second window engaging surface, and a second door engaging surface, a third frame member adapted to attach to the first outer face of the first frame member by a plurality of first screwless connectors, and a fourth frame member adapted to attach to the second outer face of the second frame member by a plurality of second screwless connectors. The first frame member is secured to the second frame member such that the window panel is held in the aperture between the first window engaging surface and the second window engaging surface and the door is held between the first door engaging surface and the second door engaging surface.

In another aspect of the present disclosure, a door assembly is disclosed including a door with an aperture, a window panel positioned within the aperture of the door, and a door lite frame assembly that mounts the window panel in the aperture of the door. The door lite frame assembly includes a first frame member having a first outer face, a first window engaging surface, and a first door engaging surface, a second frame member having a second outer face, a second window engaging surface, and a second door engaging surface, a third frame member adapted to attach to the first outer face of the first frame member by a plurality of first screwless connectors, and a fourth frame member adapted to attach to the second outer face of the second frame member by a plurality of second screwless connectors. The first frame member is secured to the second frame member such that the window panel is held in the aperture between the first window engaging surface and the second window engaging surface and the door is held between the first door engaging surface and the second door engaging surface.

In another aspect of the present disclosure, a method is disclosed for mounting a window panel in an aperture in a door. The method includes positioning the window panel within the aperture, sandwiching the portion of the window panel between a first frame member and a second frame member, sandwiching a portion of the door between a first frame member and a second frame member, fastening the first frame member to the second frame member, snapping a third frame member onto the first frame member such that a majority of a first outer face surface of the first frame member is covered by the third frame member, and snapping a fourth frame member onto the second frame member such that a majority of a second outer face surface of the second frame member is covered by the fourth frame member.

DETAILED DESCRIPTION

Detailed embodiments of the present door lite frame assemblies are disclosed herein. It is to be understood, however, that the disclosed embodiments are merely exemplary of door lite frame assemblies that may be embodied in various and alternative forms. The figures of the present application are to relative scale (i.e., the scale of one component to the other component), unless otherwise noted. Specific structural and functional details disclosed herein are not to be interpreted as limiting, but merely as a representative basis for the claims and/or as a representative basis for teaching one skilled in the art to variously employ the present invention.

Figure 1:
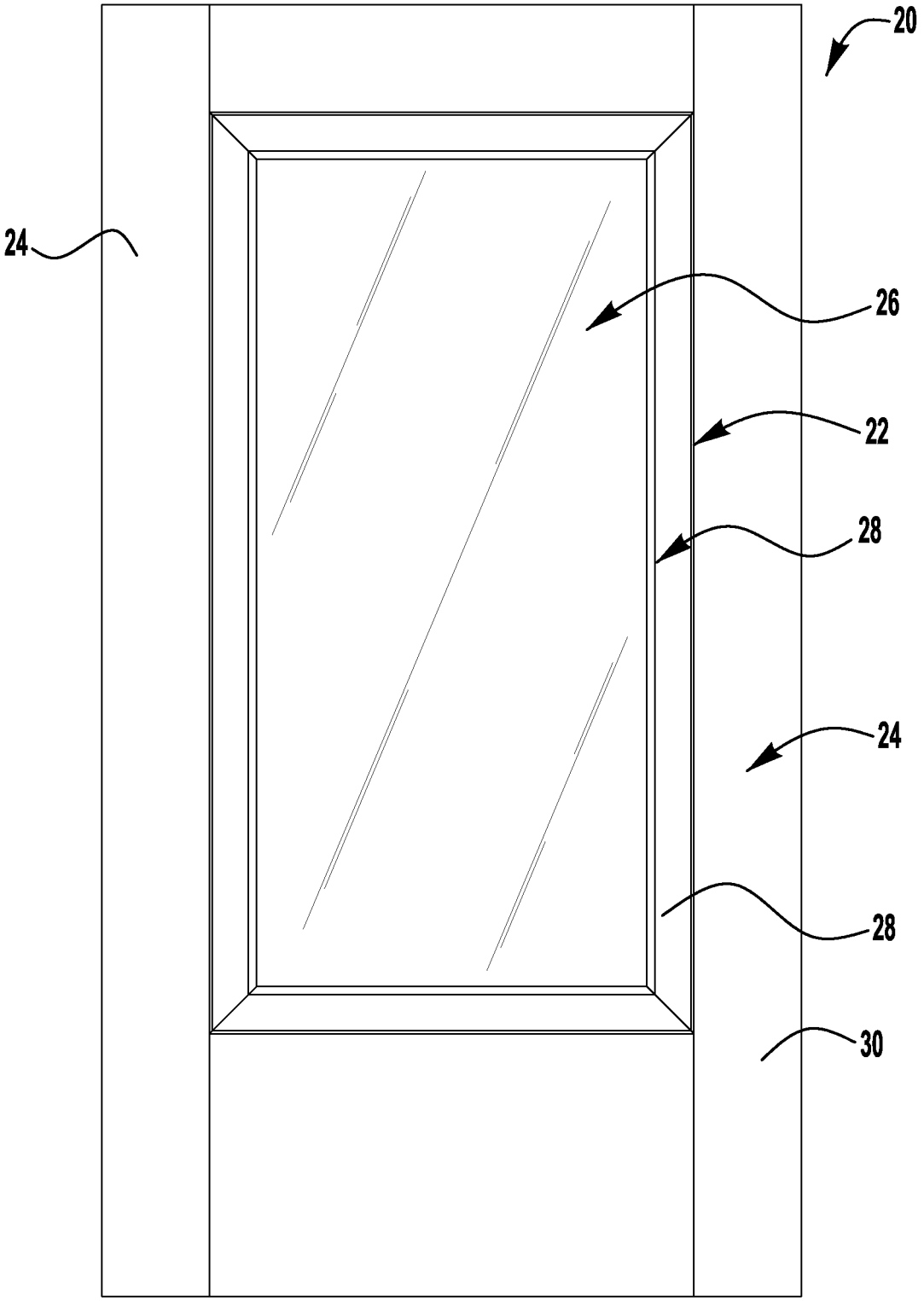
FIG. 1 is an exterior elevation view of an exemplary embodiment of a door assembly having a door lite assembly.
Figure 2:
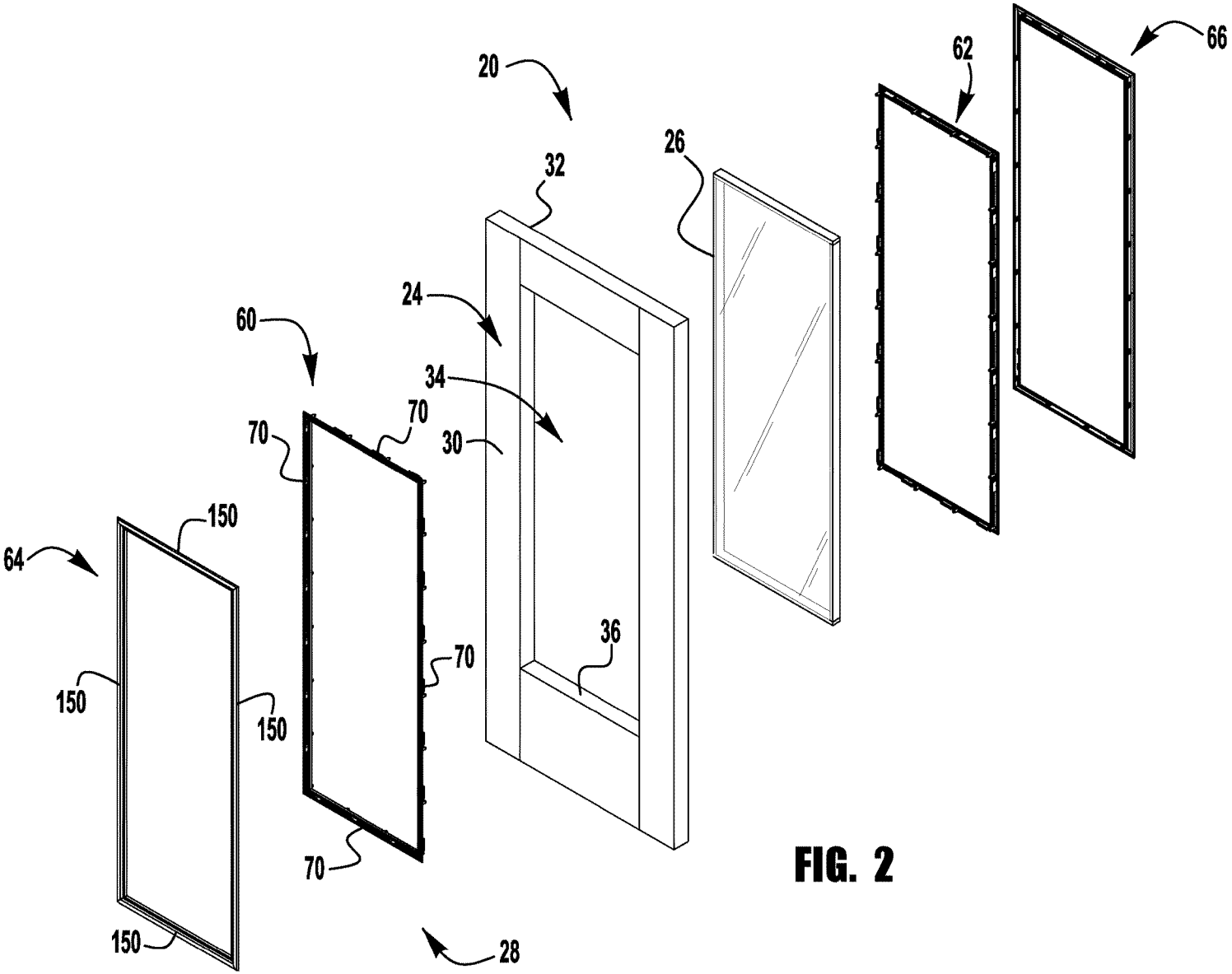
FIG. 2 is an exploded perspective view of the door assembly of FIG. 1.

FIGS. 1-2 illustrate an exemplary embodiment of a door assembly 20. The door assembly 20 includes a door lite assembly 22 and a door 24. The door lite assembly 22 includes a window panel 26 for permitting viewing through the door assembly 20 and a door lite frame assembly 28. The door 24 may be configured in a variety of ways. For example, the door 24 could be a conventional wooden door, a steel door, a molded door, or the like. The door 24 may be a residential door, a commercial door, or the like. The door 24 may be a portion of a molded door having an internal door core with door skins provided on exterior and interior sides of the door 24. Any door 24 capable of receiving a door lite assembly 22 may be used. In the exemplary embodiment, the door 24 is rectangular having a first face 30 and a second face 32 opposite, and generally parallel to, the first face 30. In other embodiments, however, the door 24 may be shaped other than rectangular.

The door 24 includes an aperture 34 that is cut, or otherwise formed, in the door 24. The aperture 34 is sized and shaped to receive the window panel 26. Both the aperture 34 and the window panel 26 may be any suitable size and shape. In the illustrated embodiment, the aperture 34 is rectangular and defined by a perimeter edge 36 that is generally perpendicular to the first face 30 and the second face 32. Likewise, in the illustrated embodiment, the window panel 26 is also generally rectangular and mimics the shape of the aperture, though slightly smaller such that the window panel 26 will fit within the aperture 34.

Figure 3:
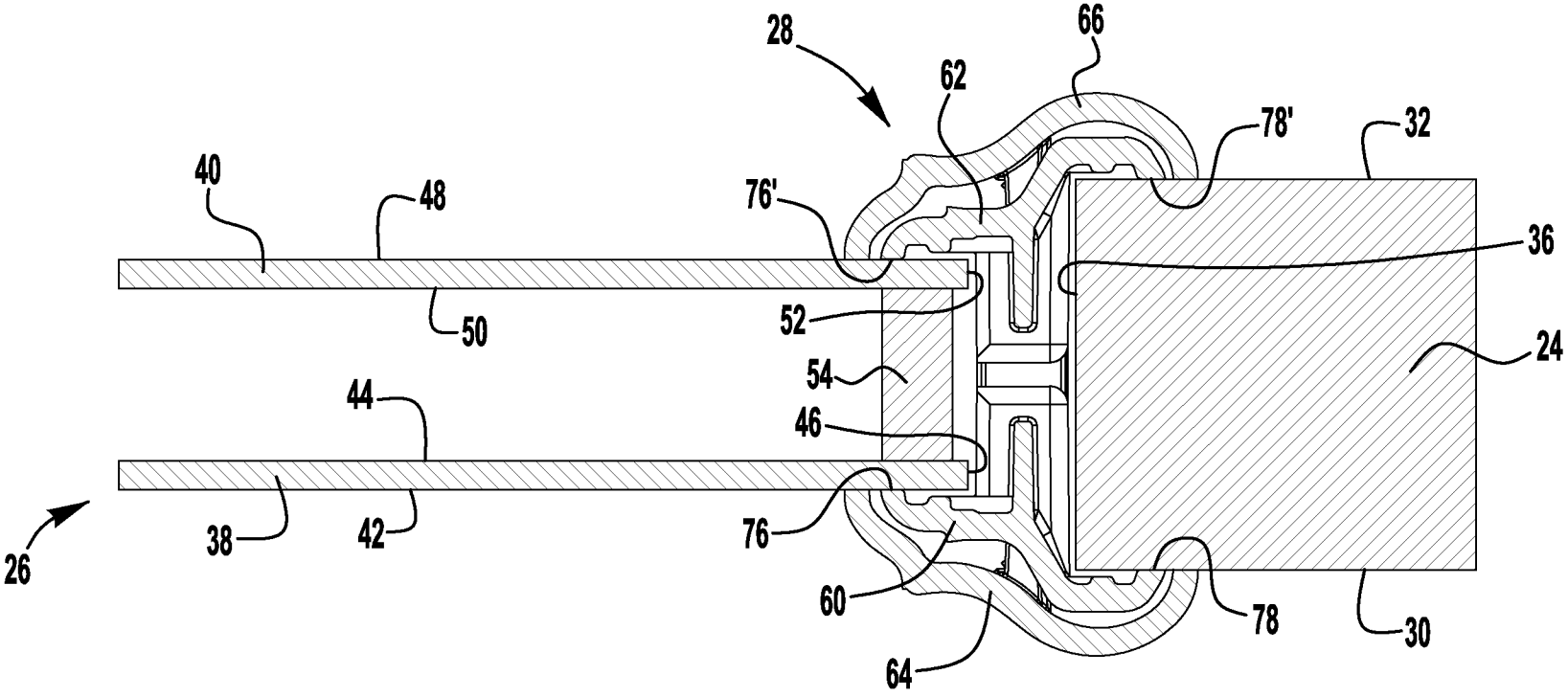
FIG. 3 is a partial cross section view of the door assembly of FIG. 1 in an assembled state.

The window panel 26 may be configured in a variety of ways, including various shapes, sizes, thicknesses, and materials. The window panel 26 may be translucent or transparent. For example, in some embodiments, the window panel 26 may include any transparent panel, such as a glass panel, composite panel, polycarbonate panel, decorative panel, acrylic panel or the like. Referring to FIG. 3, in the embodiment illustrated, the window panel 26 includes a first glass sheet 38 and a second glass sheet 40 arranged generally parallel to the first glass sheet 38. The first glass sheet 38 has a first outer face 42, a first inner face 44 opposite and generally parallel to the first outer face 42, and a first perimeter edge 46 extending between and generally parallel to the first outer face 42 and the first inner face 44. The second glass sheet 40 has a second outer face 48, a second inner face 50 opposite and generally parallel to the second outer face 48, and a second perimeter edge 52 extending between and generally parallel to the second outer face 48 and the second inner face 50. A spacer 54 is positioned between the first glass sheet 38 and the second glass sheet 40 adjacent the first perimeter edge 46 and the second perimeter edge 52. The spacer 54 maintains the insulating airspace between the first glass sheet 38 and the second glass sheet 40.

The door lite frame assembly 28 retains the window panel 26 in the aperture 34 of the door 24. The door lite frame assembly 28 may be configured in a variety of ways. For example, the size, the shape, the thickness, the number of frame members, the materials used for the frame members, and the appearance may vary in different embodiments. In one exemplary embodiment, the door lite frame assembly 28 has a functional portion that secures the window panel 26 in the aperture 34 of the door 24 and an aesthetic portion, which is separate from the functional portion, that provides the outward, visible appearance of the door lite frame assembly 28. For example, in one exemplary embodiment, a door lite frame assembly 28 includes a functional portion that holds the window panel 26 in the aperture 34 of the door 24 and an aesthetic portion that provides no support of the window panel 26 in the aperture 34, or any support that the aesthetic portion provides, is not needed to secure the window panel 26 in the aperture 34 of the door 24. The aesthetic portion may cover a majority of the functional portion. In one embodiment, aesthetic portion covers all of the functional portion so that only the aesthetic portion is outwardly visible.

Referring to FIGS. 2-3, in the illustrated embodiment, the door lite frame assembly 28 includes a first frame member 60, a second frame member 62, a third frame member 64, and a fourth frame member 66. The first frame member 60 and the second frame member 62 form the functional portion of the door lite frame assembly 28, while the third frame member 64 and the fourth frame member 66 form the aesthetic portion of the door lite frame assembly 28. In other embodiments, the functional portion and aesthetic portion may include more or less frame members or components than in the illustrated embodiment.

The first frame member 60 and the second frame member 62 may be interchangeable such that the first frame member 60 may mount against either the first face 30 or the second face 32 of the door 24 and the second frame member 62 may mount against the other face. Likewise, the third frame member 64 and the fourth frame member 66 may be interchangeable such that the third frame member 64 may mount onto either of the first frame member 60 and the second frame member 62 and the fourth frame member 66 may mount against the other of the first or second frame members 60, 62.

In the illustrated embodiment, the first frame member 60 is identical to the second frame member 62 and the third frame member 64 is identical to the fourth frame member 66. Thus, only the first frame member 60 and the third frame member 64 will be discussed in detail below. It is understood that the description of the first frame member 60 and the third frame member 64 apply equally to the second frame member 62 and the fourth frame member 66, respectively. In other embodiments, however, the first frame member 60 and the second frame member 62 may not be identical, and the third frame member 64 and the fourth frame member 66 may not be identical.

In the illustrated embodiment, the first frame member 60 is shaped to correspond to the shape of the aperture 34. Thus, the first frame member 60 is rectangular. In other embodiments, however, the first frame member 60 may be shaped other than rectangular. In the illustrated embodiment, the first frame member 60 is formed as a single piece. In other embodiments, however, the first frame member 60 may be formed by two or more pieces. For example, the first frame member 60 may include multiple pieces that are connected to form the first frame member 60.

The first frame member 60 and the second frame member 62 are configured to connect to each other to secure the window panel 26 within the aperture 34. The first frame member 60 and the second frame member 62 may also be configured to connect to and be covered by one or more aesthetic portions of the door lite frame assembly 28. The first frame member 60 may be configured in a variety of ways. Any configuration that can secure the window panel 26 within the aperture 34, and connect to one or more aesthetic portions, may be used.

Figure 5:
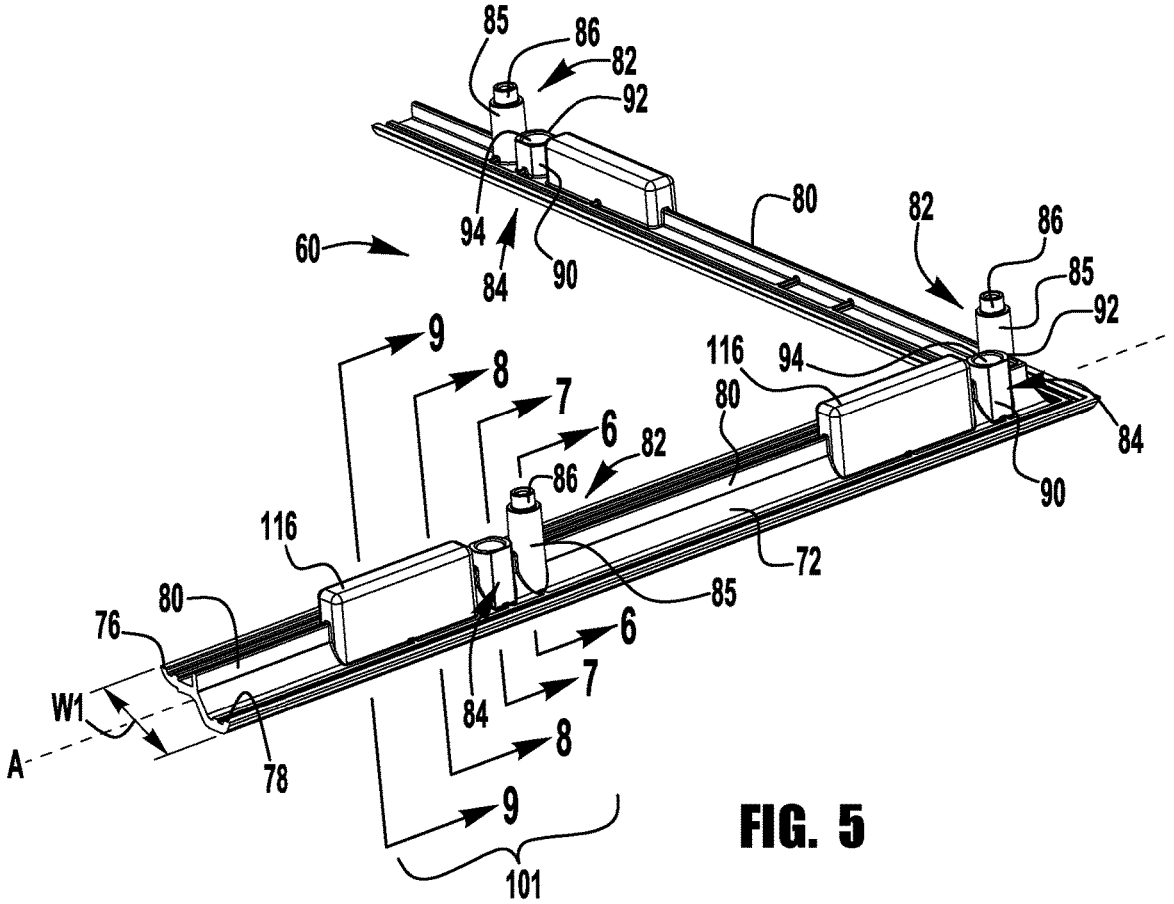
FIG. 5 is a partial rear perspective view the first frame member of an exemplary embodiment of a door lite frame assembly of the door assembly of FIG. 1.

In the illustrated embodiment, the first frame member 60 includes four elongated rails 70 that are integrally formed together are a rectangular perimeter or arranged and secured together to form a rectangular perimeter. Each of the rails 70 are essentially identical, but for the length of each rail. As shown in FIG. 5, each of the rails 70 has a width W1 and extends along a longitudinal axis A.

Figure 4:
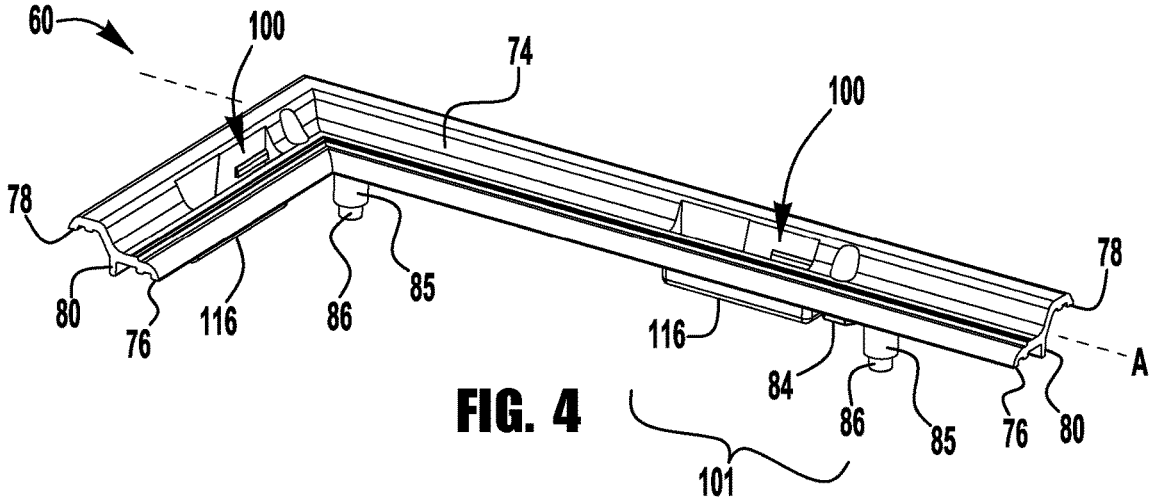
FIG. 4 is a partial front perspective view of a first frame member of an exemplary embodiment of a door lite frame assembly of the door assembly of FIG. 1.

Referring to FIGS. 4-5, the first frame member 60 includes an inner face surface 72 and an outer face surface 74 opposite the inner face surface 72. The contour of the inner face surface 72 and the outer face surface 74 generally mirror each other and can vary in different embodiments of the first frame member 60. In other embodiments, however, the contour of the inner face surface 72 and the outer face surface 74 may not mirror each other. The first frame member 60 includes an inner longitudinal edge 76 and an outer longitudinal edge 78 opposite the inner longitudinal edge 76. Both the inner longitudinal edge 76 and the outer longitudinal edge 78 face inward when the first frame member 60 is assembled.

The inner face surface 72 includes a longitudinal rib 80 that extends, discontinuously, along the length of the first frame member 60. The longitudinal rib 80 adds strength and stability to the first frame member 60, especially when the first frame member 60 is being handled.

The inner face surface 72 also includes structure to facilitate attaching the first frame member 60 to the second frame member 62. The structure may be configured in a variety of ways. In the illustrated embodiment, the first frame member 60 includes a series of spaced apart screw bosses 82, a series of spaced apart alignment bosses 84 extending outward from the inner face surface 72, and a series of spaced apart pockets 100. In the illustrated embodiment, the screw bosses 82, the alignment bosses 84, and the pockets 100 are arranged in a plurality of groups 101, where each group 101 is formed by one of the series of screw bosses 82, one of the series of alignment bosses 84, and one of the series pockets 100. In other embodiments, however, the arrangement each of the individual, or series of, screw bosses 82, alignment bosses 84, and/or pockets 100 may be different. In the illustrated embodiment, one of the groups 101 is positioned at each corner of the first frame member 60, as shown in FIGS. 2, 4, and 5.

In the illustrated embodiment, the longitudinal rib 80 connects to, and extends between, each of the screw bosses 82 and the alignment bosses 84 to add strength to the screw bosses 82, to the alignment bosses 84, and to the pockets 100 and serves to tie the groups 101 together for distributing loading and impact forces.

Figure 14:
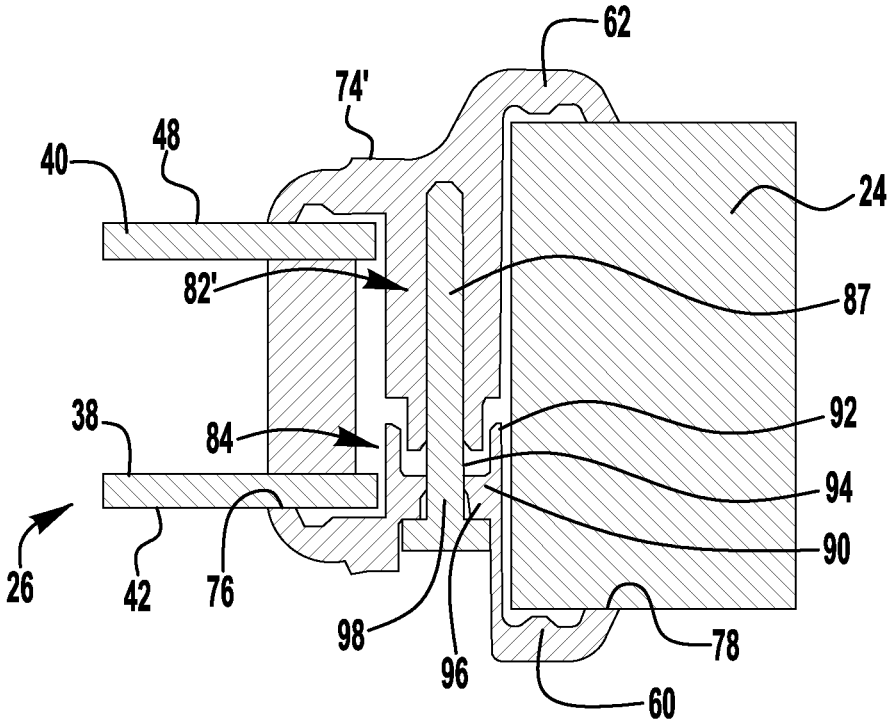
FIG. 14 is a cross section view of the door assembly of FIG. 1 illustrating first and second frame members fastened together.
Figure 15:
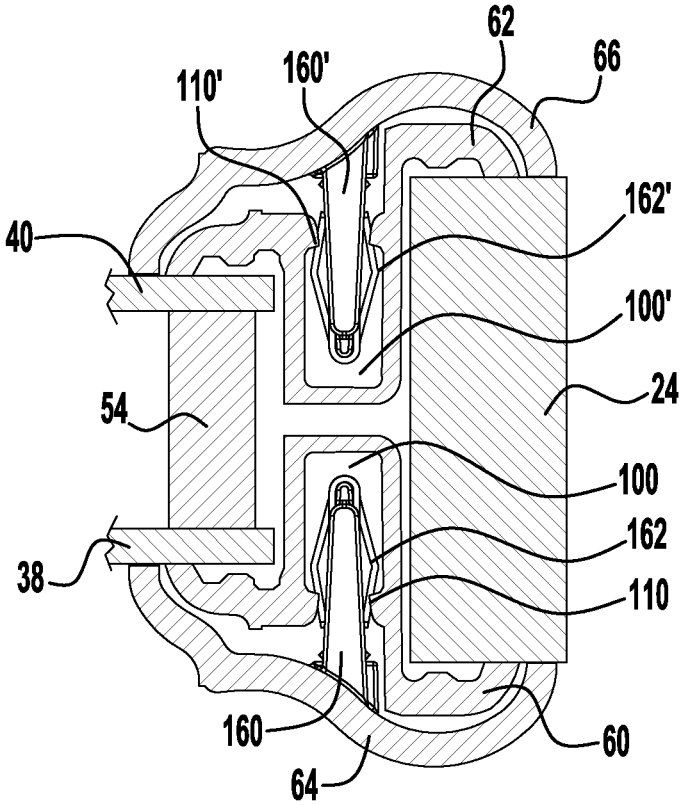
FIG. 15 is a cross section view of the door assembly of FIG. 1 illustrating third and fourth frame members attached to first and second frame members, respectively.

Each of the screw bosses 82 is configured to be partially received into a corresponding alignment boss 84 of the second frame member 62 and are configured to receive a fastener 87 (FIG. 14), such as a screw, to fasten the first frame member 60 to the second frame member 62. The screw bosses 82 and the alignment bosses 84 may be configured in a variety of ways, including different shapes, lengths, and thickness. Any configurations that allow one or more of the screw bosses 82 to be at least partially received in one or more corresponding alignment bosses 84 to facilitate fastening the first frame member 60 to the second frame member 62, may be used.

Figure 6:
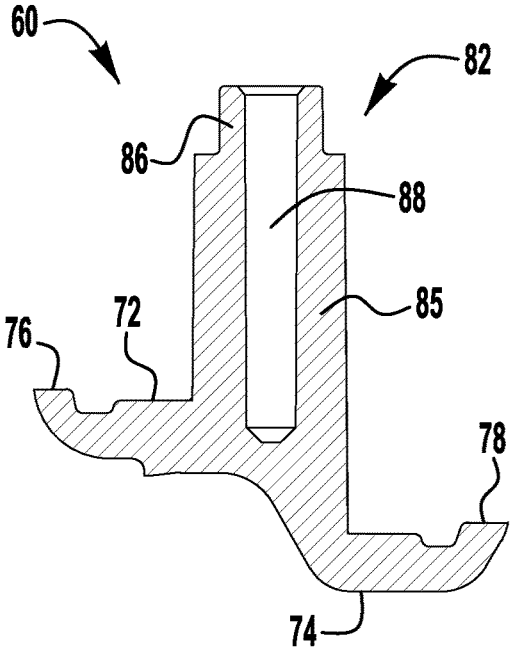
FIG. 6 is a cross section view of the first frame member of FIG. 5, along the 6-6 line.

As shown in FIG. 6, in the illustrated embodiment, each of the screw bosses 82 has a body portion 85 and a tip portion 86 defining a distal end of the screw boss 82. A fastener receiving passage 88 extends from the tip portion 86 into the body potion 85. The fastener receiving passage 88 is open at the tip portion 86 and terminates in the body portion 85. The fastener receiving passage 88, in some embodiments may include internal threads or other means for engaging a fastener 87.

Figure 7:
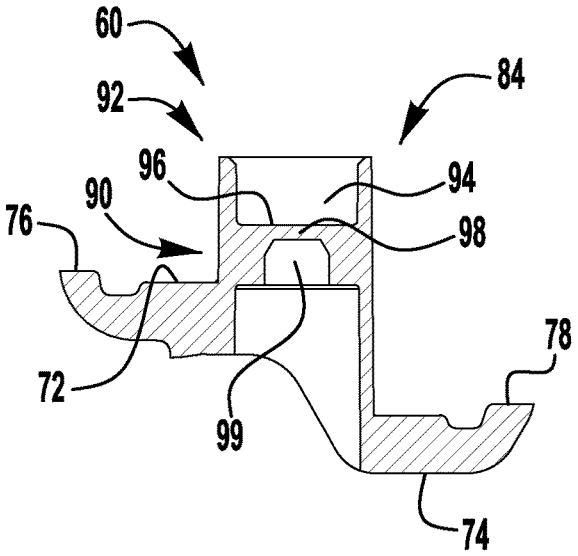
FIG. 7 is a cross section view of the first frame member of FIG. 5, along the 7-7 line.

Referring to FIG. 7, each of the alignment bosses 84 includes a base portion 90 attached to the inner face surface 72 and an end portion 92 opposite the base portion 90. A passage 94 extends from the end portion 92 into the base portion 90. The passage 94 is open at the end portion 92 and terminates at an end wall 96 in the base portion 90. The end wall 96 is configured to be pierced by the fastener 87. For example, the end wall 96, or a portion of the end wall 96, may have an area of weakness 98, such as a thinner portion, to facilitate being pierced by a fastener 87. In the illustrated embodiment, the area of weakness 98 is formed by a counterbore 99 extending inward from the outer face surface 74.

The passage 94 is sized and configured to receive the tip portion 86, or both the tip portion 86 and a portion of the body potion 85, of the screw boss 82 of the second frame member 62. In the illustrated embodiment, each screw boss 82 is positioned next to an alignment boss 84 as a pair. The first frame member 60 includes multiple screw boss 82/alignment boss 84 pairs, spaced apart from one another and spaced around the perimeter of the first frame member 60 along the inner face surface 72.

Figure 8:
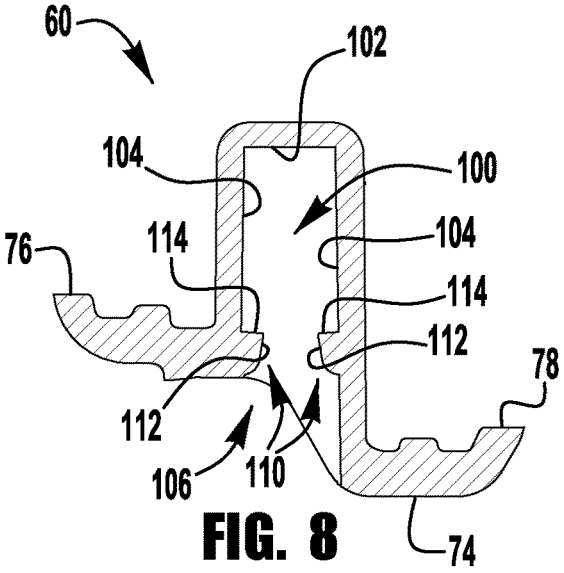
FIG. 8 is a cross section view of the first frame member of FIG. 5, along the 8-8 line.

The first frame member 60 may also include structure configured to facilitate attaching the first frame member 60 to the third frame member 64. In some embodiments, the structure facilitates attaching the first frame member 60 to the third frame member 64 without the use of an additional fasteners, such as screws. The structure can be configured in a variety of ways. For example, the structure may interface with structure on the third frame member to form a snap fit. In some embodiments, the snap fit can be released by force applied to the third frame member 64. Referring to FIG. 8, in the illustrated embodiment, the first frame member 60 includes multiple pockets 100 extending into the outer face surface 74. The pockets 100, as illustrated, are generally rectangular in cross section and include an end wall 102 and four side walls 104, with each side wall 104 being generally perpendicular to two adjacent side walls 104. The pocket 100 includes an open end 106 opposite the end wall 102 such that the pocket 100 is open at the outer face surface 74, but closed by the other walls.

The pockets 100 include one or more catches 110 or other retaining structure for connecting to the third frame member 64. The one or more catches 110 can be configured in a variety of ways. In the illustrated embodiment, a catch 110 extends from each of two opposing side walls 104 of the pocket 100. In other embodiments, one or more catches 110, however, may extend from any one or more side walls 104. In the illustrated embodiment, each of the one or more catches 110 are formed integrally with the sidewalls 104. In other embodiments, however, the one or more catches 110 may not be formed integrally but may be a separate component attached to the first frame member 60. Further, in some embodiments, the catch 110 may not extend from a side wall but may be formed in another manner. For example, a flexible tab (not shown) having a catch may be positioned within the pocket 100, such as extending from the end wall 102 toward the open end 106. Still further, in some embodiments, the catch 110 may be formed as a recess in the side wall 104 to engage a projection on the third frame member 64. In the illustrated embodiment, each catch 110 includes a ramped surface 112 facing the open end 106 and a shoulder 114 facing the end wall 102.

Figure 9:
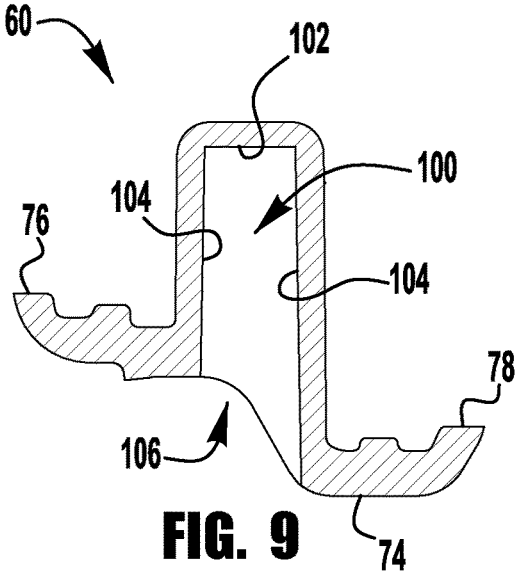
FIG. 9 is a cross section view of the first frame member of FIG. 5, along the 9-9 line.

As shown in FIGS. 4, 8, and 9, in the illustrated embodiment, each of the pockets 100 include a first portion 120 (FIG. 8) that includes one or more catches 110 and a second portion 122 (FIG. 9) that is free of catches 110.

As indicated above, in the illustrated embodiment, the second frame member 62 is identical to the first frame member 60. Thus, second frame member 62 includes a series of spaced apart screw bosses 82' and a series of spaced apart alignment bosses 84' extending outward from the inner face surface 72' and multiple pockets 100' extending into the outer face surface 74'.

In the illustrated embodiment, the third frame member 64 is shaped to correspond to the shape of the aperture 34. Thus, the third frame member 64 is rectangular. In other embodiments, however, the third frame member 64 may be shaped other than rectangular. In the illustrated embodiment, the third frame member 64 is formed as a single piece. In other embodiments, however, the third frame member 64 may be formed by two or more pieces. For example, the third frame member 64 may include multiple pieces that are connected to form the rectangular third frame member 64.

The third frame member 64 is configured to connect to and cover a majority of, or all of, the outer face surface 74 of the first frame member 60 such that the first frame member 60 is not visible, or only partially visible, when the door lite frame assembly 28 is assembled on the door 24. In this way, any fasteners 87 used to connect the first frame member 60 to the second frame member 62 will be hidden when the third frame member 64 and/or the fourth frame member 66 are connected to the first frame member 60 and the second frame member 62, respectively.

Further, the third frame member 64 is not utilized by the door lite frame assembly 28 to secure the window panel 26 to the door 24. The third frame member 64 may be configured in a variety of ways. Any configuration that can connect to and cover the first frame member 60 such that the first frame member 60 is not visible, or only marginally visible, may be used. The third frame member 64 is configured to connect to the first frame member 60 via a screwless connection. The screwless connection can be configured in a variety of ways. Any way of connecting the third frame member 64 to the first frame member 60 without using screws may be used. For example, the screwless connection may be a snap fit or a friction fit, may utilize clips, tabs, or clamps, or any other suitable screwless connection. In one exemplary embodiment, the screwless connection acts as a detent that secures the third frame member 64 to the first frame member 60 but allows the third frame member 64 to be released and removed from the first frame member 60 with the application of sufficient force and without tools.

Referring to FIG. 2, in the illustrated embodiment, the third frame member 64 includes four elongate rails 150 that are integrally formed together as a rectangular perimeter or arranged and secured together to form a rectangular perimeter. Each of the rails 150 are essentially identical, but for the length of each rail. Each of the rails 150 has a width W3 and extends along a longitudinal axis B.

Figure 10:
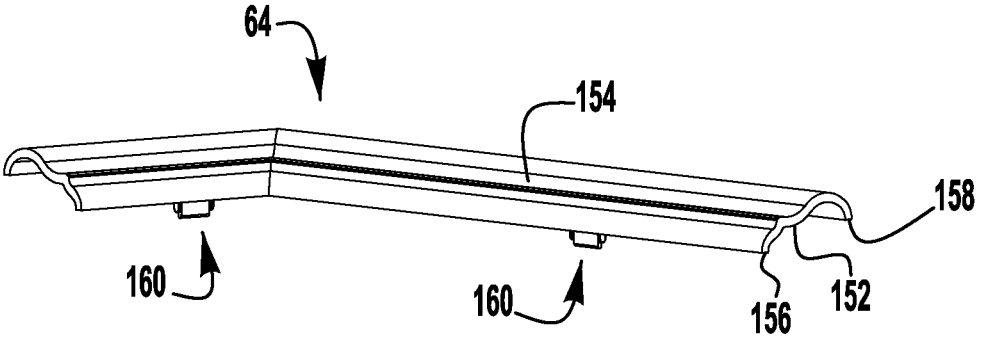
FIG. 10 is a partial front perspective view of a third frame member of an exemplary embodiment of a door lite frame assembly of the door assembly of FIG. 1.
Figure 11:
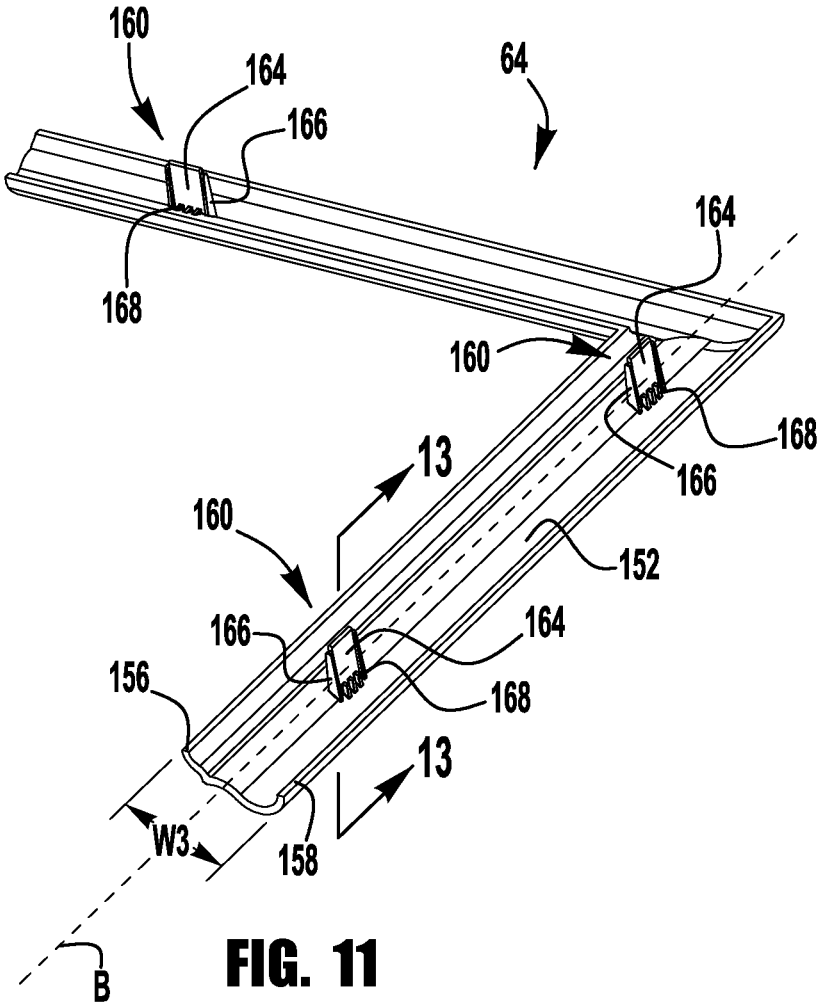
FIG. 11 is a partial rear perspective view of a third frame member of an exemplary embodiment of a door lite frame assembly of the door assembly of FIG. 1.

Referring to FIGS. 10-11, the third frame member 64 includes an inner face surface 152 and an outer face surface 154 opposite the inner face surface 152. The contour of the inner face surface 152 and the outer face surface 154 generally mirror each other and can vary in different embodiments of the third frame member 64. In other embodiments, however, the contour of the inner face surface 152 and the outer face surface 154 may not mirror each other.

The third frame member 64 includes an inner longitudinal edge 156 and an outer longitudinal edge 158 opposite the inner longitudinal edge 156. Both the inner longitudinal edge 156 and the outer longitudinal edge 158 face inward when the third frame member 64 is assembled.

Figure 12:
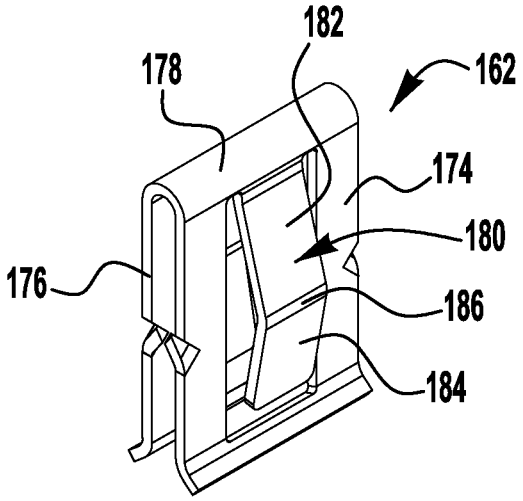
FIG. 12 is perspective view of an exemplary embodiment of a clip for third frame member of FIG. 11.
Figure 13:
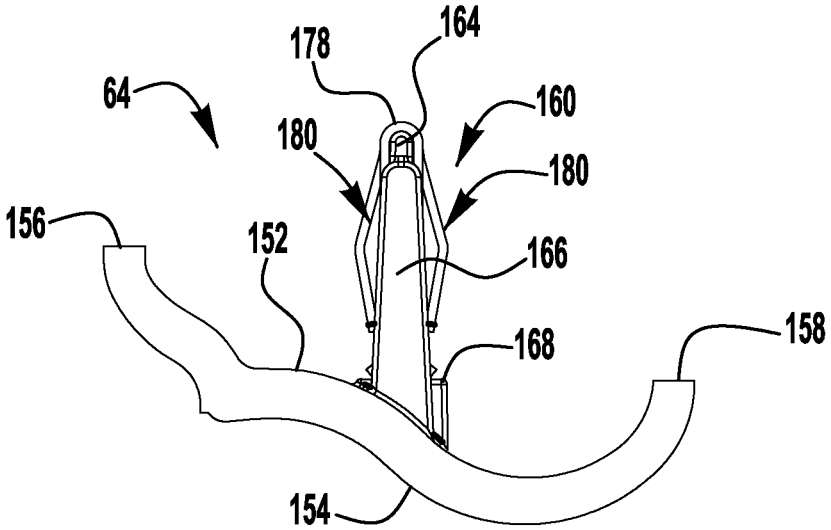
FIG. 13 is a cross section view of the third frame member of FIG. 5, along the 12-12 line.

The inner face surface 152 includes structure to facilitate attaching the third frame member 64 to the first frame member 60. The structure may be configured in a variety of ways. In the illustrated embodiment, the third frame member 64 includes a series of spaced apart tabs 160 extending outward from the inner face surface 152. Each of the tabs 160 is configured to be attached to and support a clip 162 (FIG. 12). The tabs 160 and clips 162 are configured to be at least partially received into a corresponding pocket 100 on the first frame member 60 and engage with the one or more catches 110 in that pocket 100 to attach the third frame member 64 to the first frame member 60. In other embodiments, however, the tabs 160 may include all of the structure needed to attach the third frame member 64 to the first frame member 60 and the embodiments do not include clips.

The tabs 160 and clips 162 may be configured in a variety of ways, including different shapes, lengths, and thicknesses. Any configurations that allows each the clip 162, and/or tab 160, to engage the catches 110 in the pocket 100 in which they are received to attach the third frame member 64 to the first frame member 60 may be used. As shown in FIGS. 11-12, for example, each tab 160 includes a generally planar portion 164 extending from the inner face surface 152 of the third frame member 64 and configured such that the clip 162 may be received onto the generally planar portion 164. In the illustrated embodiment, the tab 160 also includes flanges 166 on either side of the generally planar portion 164 for retaining the clip 162 in position on the tab 160. The tab 160 also includes one or more stop surfaces 168 adjacent the inner face surface 152 for properly positioning the clip 162 when the clip 162 is received onto the generally planar portion 164.

Referring to FIG. 12, the clip 162 is configured to fit over top of and be received onto the generally planar portion 164 of the tab 160. In the illustrated embodiment, the clip 162 is generally U-shaped having a first side 174, a second side 176 spaced apart from the first side 174, and a tip portion 178 connecting the first side 174 to the second side 176. Both the first side 174 and the second side 176 include one or more of the projections 180 extending therefrom for engaging the catches 110 of the first frame member 60. In other embodiments, however, the clip 162 may only include a single projection 180 on one of the first side or second side 174, 176.

Each projection 180 is configured to engage a catch 110 to retain the third frame member 64 onto the first frame member 60. In the illustrated embodiment, each projection 180 includes a first ramped surface 182 and a second ramped surface 184 that form a ridge 186 therebetween. The projections 180, however, may have any suitable configuration.

The projections 180 are configured to flex when engaging one of the catches 110 of the first frame member 60. Alternatively, or in addition, the catch 110 may flex when engaging the projections 180. The clips 162 may be formed by any one or more suitable materials, such as plastic, metal, or other suitable materials.

The outer face surface 154 of third frame member 64 may be configured include ornamental features, such as for example an ornamental contour of the outer face surface 154 or patterns/textures on the outer face surface 154. The outer face surface 154 may include any suitable ornamental features, such as for example, a relatively complex geometry for replicating a profile of conventional wooden moldings. The outer face surface 154 may form any shape, such as arcuate, along its length for providing various styles.

As indicated above, in the illustrated embodiment, the third frame member 64 is identical to the fourth frame member 66. Thus, fourth frame member 62 includes a series of tabs 160' and clips 162' extending outward from the inner face surface 152' of the fourth frame member 62.

The frame members 60, 62, 64 66 may be formed from any suitable material or materials, such as a polymeric or a composite material. The frame members 60, 62, 64 66 can be made from a wide variety of different plastic materials. In one exemplary embodiment, the frame members 60, 62, 64 66 may be made from an inexpensive fiberglass reinforced plastic material, such as fiberglass reinforced polypropylene.

The first and second frame member 60, 62 may be formed from the same materials or from different materials than the third and fourth frame member 64, 66. In one exemplary embodiment, the third and fourth frame member 64, 66 are made of a composite resin that is paintable and/or stainable. Since, the third and fourth frame member 64, 66 cover the first and second frame member 60, 62, the first and second frame member need not be paintable and/or stainable and can be formed from a different material. In some embodiments, the first and second frame member 60, 62 may be black to better hide them under the third and fourth frame member 64, 66. The frame members 60, 62, 64 66 may be injection molded, molded by other means, extruded, or otherwise formed.

When assembled, the door lite frame assembly 28 secures the window panel 26 within the aperture 34 of the door 24. The first frame member 60 and the second frame member 62 attach to each other and secure the window panel 26 to the door 24 and the third frame member 64 and the fourth frame member 66 attach to the first frame member 60 and the second frame member 62, respectively, to provide the aesthetic quality to the door assembly 20. Since the third frame member 64 and the fourth frame member 66 attach to the first frame member 60 and the second frame member 62, respectively, via a screwless connection, the third frame member 64 and the fourth frame member 66 can be readily removed and changed by an end user without disassembling or loosening the attachment of the window panel 26 to the door 24.

In particular, referring to FIGS. 3 and 12, when assembled, the first frame member 60 is aligned with the second frame member 62 with the inner face surfaces 72, 72' facing each other. The inner longitudinal edge 76 of the first frame member 60 engages first outer face 42 of the first glass sheet 38 and the outer longitudinal edge 78 of the first frame member 60 engages the first face 30 of the door 24. Similarly, the inner longitudinal edge 76' of the second frame member 62 engages second outer face 48 of the second glass sheet 40 and the outer longitudinal edge 78' of the second frame member 62 engages the second face 32 of the door 24. Thus, the door is sandwiched between the door engaging surfaces on first and second frame member 60, 62 and the window panel 26 is sandwiched between the window engaging surfaces on the first and second frame member 60, 62.

The first frame member 60 is attached to the second frame member 62 via fasteners 87, such as screws. In particular, the first frame member 60 may be positioned on the interior side of the door 24 and aligned with the second frame member 62 such that the screw bosses 82' of the second frame member 62 are received in the alignment bosses 84 of the first frame member 60. The alignment bosses 84 are configured to aid in aligning the first and second frame members 60, 62, but do not grip the screw bosses 82'. Thus, in some embodiments, the clearance between the alignment bosses 84 and the screw bosses 82' allow for some relative movement between the first frame member 60 and the second frame member 62 for adjusting the relative position of the frame members 60, 62.

Once the first frame member 60 and the second frame member 62 are aligned, the area of weakness 98 in the end wall 96 of the first frame member 60 may be punctured and one of the fasteners 87 is inserted through the end wall 96 and into the screw boss 82' of the second frame member 62 and tightened, such as by threads on the inner surface of the passage 88'. The fastener 87 inserted through the end wall 96 and into the screw boss 82' may be used to puncture the area of weakness 98 in the end wall 96 while being inserted. However, the area of weakness 98 in the end wall 96 of may be punctured by other means prior to the fastener 87 being inserted.

Preferably, screws are inserted through the end wall 96 of the alignment bosses 84 on the first frame member 60 since, in the example above, it is positioned on the interior side of the door 24, while screws are not inserted through the alignment bosses 84' of the second frame member 62 since it is on the exterior side of the door. Thus, the fasteners 87 that hold the door lite frame assembly, window panel 26, and door 24 together are not accessible from the exterior side of the door 24. Further, the end walls 96' of the on the second frame member 62 are not pierced, thus there is not concern with water infiltration through the alignment bosses. In addition, in the illustrated embodiment, due to a screw boss 82 being located at, or proximate, each corner of the frame assembly, warping in the corners is reduced and water sealing performance is improved.

After the first frame members 60 and the second frame member 62 are secured in place via fasteners and, thus, secure the window panel 26 within the aperture 34 of the door 24, the third and fourth frame members 64, 66 may be attached to the first and second frame members 60, 62, respectively. The third and fourth frame members 64, 66 are configured to attach to the first and second frame members 60, 62, respectively, via a screwless connection.

In particular, to attach the third frame member 64 to the first frame member 60, the third frame member 64 is positioned such that the inner face surface 152 of the third frame member 64 faces the outer side surface 74 of the first frame member 60. The third frame member 64 is then aligned with the first frame member 60 such that the tabs 160 and clips 162 of the third frame member 64 are received in the pockets 100 of the first frame member 60. The third frame member 64 can then be moved toward the first frame member 60 such that the clips 162 engage the catches 110 in each of the pockets 100. One or all of the projections 180, the tabs 160, and catches 110 deflect or flex to allow the ridge 186 on the projections 180 to pass the catches 110. Once past, the projections 180, the tabs 160 and/or the catches 110 flex back such that the shoulder 114 blocks the ridge 186 to resist withdrawing the tab 160 from the pocket 100. The position of the tabs 160 and the catches 110 are such that the third frame member 64 is held tightly to the first frame member 60 in a latched position.

The third frame member 64, however, can be removed from the first frame member 60 by pulling the third frame member 64 away from the first frame member 60 with sufficient force to cause one or all of the projections 180, the tabs 160, and catches 110 to deflect or flex to allow the ridge 186 to pass the catches 110. Thus, the screwless connection between the third frame member 64 and first frame member 60 acts as a detent.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

The invention claimed is:

1. A frame arrangement for retaining a window panel in an aperture in a door, the frame arrangement comprising:

a first frame member defining a first perimeter and having a first outer face, a first inner peripheral window engaging surface, and a first outer peripheral door engaging surface;

a second frame member defining a second perimeter and having a second outer face, a second inner peripheral window engaging surface, and a second outer peripheral door engaging surface;

a third frame member defining a third perimeter matching the first perimeter and being sized and shaped to cover at least a majority of the first frame member, the third frame member being attachable to the first outer face of the first frame member by a plurality of first screwless connectors; and a fourth frame member defining a fourth perimeter matching the second perimeter and being sized and shaped to cover at least a majority of the second frame member, the fourth frame member being attachable to the second outer face of the second frame member by a plurality of second screwless connectors;

wherein the first frame member is securable to the second frame member to hold a window panel in the aperture of the door, such that the window panel is held between the first inner peripheral window engaging surface and the second inner peripheral window engaging surface and the door is held between the first outer peripheral door engaging surface and the second outer peripheral door engaging surface, with each of the first and second frame members contacting the door and contacting an exterior surface of the window panel to effect a perimeter seal between the window panel and the door.

2. The frame arrangement of claim 1, wherein the first frame member is interchangeable with the second frame member.

3. The frame arrangement of claim 1, wherein the third frame member is interchangeable with the fourth frame member.

4. The frame arrangement of claim 1, wherein the first frame member includes a plurality of first screw bosses and a plurality of first alignment bosses extending from an inner face surface of the first frame member, wherein the second frame member includes a plurality of second screw bosses and a plurality of second alignment bosses extending from an inner face surface of the second frame member, and wherein, when the first frame member is secured to the second frame member, the first screw bosses are at least partially received in the second alignment bosses and the second screw bosses are at least partially received in the first alignment bosses.

5. The frame arrangement of claim 4, wherein each of the first alignment bosses has an open end and an end wall opposite the open end, and a fastener extends through the end wall of each of the first alignment bosses and into a corresponding second screw boss.

6. The frame arrangement of claim 4, wherein each of the plurality of first screw bosses and each of the plurality of first alignment bosses are arranged as pairs, wherein each pair is spaced apart from another pair and the pairs extend around the inner face surface of the first frame member.

7. The frame arrangement of claim 1, wherein each of the plurality of first screwless connectors provides a snap-fit between the third frame member and the first frame member.

8. The frame arrangement of claim 1, wherein each of the plurality of first screwless connectors includes a catch on the outer face surface of the first frame member and a tab on an inner face surface of the third frame member, wherein the catch is configured to cooperate with the tab to secure the third frame member to the first frame member.

9. The frame arrangement of claim 8, wherein the first frame member includes a plurality of pockets formed on the outer side of the first frame member, and wherein each catch of the plurality of first screwless connectors is positioned within a corresponding one of the plurality of pockets.

10. The frame arrangement of claim 9, wherein each of the tabs is received within a corresponding pocket when the first frame member is secured to the third frame member.

11. The frame arrangement of claim 9, wherein each pocket includes a pair of catches disposed on opposing sidewalls of the pocket.

12. The frame arrangement of claim 8, wherein each of the plurality of first screwless connectors further comprises a clip attached to each tab, wherein the clip is configured to engage the catch.

13. The frame arrangement of claim 1, wherein the third frame member covers the entire first outer side of the first frame member when attached to the first frame member.

14. The frame arrangement of claim 1, wherein the plurality of first screwless connectors act as a detent allowing the third frame member to be removed from the first frame member.

15. The frame arrangement of claim 1, wherein the first frame member is formed as a single piece.

16. A method of mounting a window panel in an aperture in a door, the method comprising:

positioning the window panel within the aperture;

sandwiching a portion of the window panel between an inner peripheral window engaging surface of a first frame member defining a first perimeter sized and shaped to correspond to the aperture and an inner peripheral window engaging surface of a second frame member defining a second perimeter sized and shaped to correspond to the aperture;

sandwiching a portion of the door between an outer peripheral door engaging surface of the first frame member and an outer peripheral door engaging surface of the second frame member;

fastening the first frame member to the second frame member to hold the window panel in the aperture, with each of the first and second frame members contacting the door and contacting an exterior surface of the window panel to effect a perimeter seal between the door and the window panel;

securing a third frame member onto the first frame member by a screwless connection such that at least a majority of a first outer face surface of the first frame member is covered by the third frame member, the third frame member having a third perimeter matching the first perimeter; and securing a fourth frame member onto the second frame member by a screwless connection such that at least a majority of a second outer face surface of the second frame member is covered by the fourth frame member, the fourth frame member having a fourth perimeter matching the third perimeter.

17. The method of claim 16, wherein the window is secured within the aperture prior to securing the third frame member onto the first frame member and securing the fourth frame member onto the second frame member.

18. The method of claim 16, further comprising pulling the third frame member away from the first frame member to disconnect the third frame member from the first frame member.

19. The method of claim 16 wherein the securing the fourth frame member onto the second frame member precedes securing the securing the third frame member onto the first frame member.

20. The method of claim 16 wherein fastening the first frame member to the second frame member further comprises puncturing an end wall of first frame member and extending a fastener through the end wall.

21. A door assembly, comprising:

a door having an aperture;

a window panel positioned within the aperture of the door; and a door lite frame assembly that mounts the window panel in the aperture of the door, the door lite frame assembly comprising:

a first frame member defining a first perimeter sized and shaped to correspond to the door aperture, and having a first outer face, a first inner peripheral window engaging surface, and a first outer peripheral door engaging surface;

a second frame defining a second perimeter sized and shaped to correspond to the door aperture, and having a second outer face, a second inner peripheral window engaging surface, and a second outer peripheral door engaging surface;

a third frame member defining a third perimeter matching the first perimeter and being sized and shaped to cover at least a majority of the first frame member, the third frame member being attached to the first outer face of the first frame member by a plurality of first screwless connectors; and a fourth frame member defining a fourth perimeter matching the second perimeter and being sized and shaped to cover at least a majority of the second frame member, the fourth frame member being attached to the second outer face of the second frame member by a plurality of second screwless connectors;

wherein the first frame member is secured to the second frame member such that the window panel is held in the aperture between the first inner peripheral window engaging surface and the second inner peripheral window engaging surface and the door is held between the first outer peripheral door engaging surface and the second outer peripheral door engaging surface, with each of the first and second frame members contacting the door and contacting an exterior surface of the window panel to effect a perimeter seal between the door and the window panel.

22. The door assembly of claim 21, wherein the plurality of first and second screwless connectors extend between an inner perimeter edge of the aperture and an outer perimeter edge of the window panel.

* * * * *